United States Patent [19]

Balz

[11] 4,307,544

[45] Dec. 29, 1981

[54] FINISHING MACHINE WITH ABRASIVE LINED CHAMBER AND METHOD OF FINISHING

[75] Inventor: Gunther W. Balz, Kalamazoo, Mich.

[73] Assignee: Roto-Finish Company, Inc., Kalamazoo, Mich.

[21] Appl. No.: 98,256

[22] Filed: Nov. 28, 1979

[51] Int. Cl.[3] ..... B24B 31/06

[52] U.S. Cl. ..... 51/163.2; 51/7; 51/313; 51/295

[58] Field of Search ..... 51/163.1, 163.2, 7, 51/73, 296, 299, 293, 295, 313

[56] References Cited

U.S. PATENT DOCUMENTS

| | | | |
|---|---|---|---|
| 1,244,452 | 10/1977 | Hamlin | 51/73 R |
| 2,387,138 | 10/1945 | Fruth | 51/73 |
| 2,422,153 | 6/1947 | Nimwegen | 51/299 |
| 2,972,527 | 2/1961 | Upton | 51/296 |
| 3,177,056 | 4/1965 | Hofelmann | 51/296 |
| 3,213,568 | 10/1965 | Setzler | 51/163.1 |
| 3,252,775 | 5/1966 | Guilbert | 51/296 |
| 3,422,577 | 1/1969 | McKibben | 51/163.2 |
| 3,906,684 | 9/1975 | Marshall | 51/296 |
| 4,162,900 | 7/1979 | Judd | 51/295 |

*Primary Examiner*—Harold D. Whitehead
*Attorney, Agent, or Firm*—Gordon W. Hueschen

[57] ABSTRACT

The present application provides a finishing chamber lining, particularly suited for use in an industrial type finishing machine, comprising a compressible elastomeric substrate having a particulate, insoluble, abrasive material uniformly distributed therethrough and having a working or outer surface, the abrasive material having a particle size between one (1) and 100 microns and a hardness, as measured on the Mohs Hardness Scale, of at least one (1), the abrasive material being insoluble in the elastomeric substrate and in reactants and solvents employed in producing the same, the working surface comprising an outermost abrasive-interspersed, gripping surface which is adapted to be self-regenerating upon erosion in use. The finishing chamber lining increases the work action within the finishing chamber and minimizes inactivity, depression, or dead spots within the finishing chamber when in use with loose finishing media and workpieces to be finished therein. Finishing chambers lined with the same, finishing machines comprising such lined finishing chambers, and method of making and using, are also provided.

12 Claims, 3 Drawing Figures

FINISHING MACHINE WITH ABRASIVE LINED CHAMBER AND METHOD OF FINISHING

BACKGROUND OF THE INVENTION

1. Field of the Invention

Finishing chamber linings, finishing chambers lined therewith, various finishing machines comprising such lined finishing chambers, and method of making and using the same.

2. Prior Art

The art is replete with so-called finishing machines of various types, especially vibratory or gyratory types, with or without additional rotative action, or with rotative or centrifugal action alone, and of course tumbling barrels are a type of finishing machine which have been known for years. As the art has progressed, the finishing chambers employed have been lined with an elastomeric substrate of either natural or synthetic nature for prevention of damage to parts or workpieces being finished due to impingement thereof upon the inner surface of the finishing chamber during the process of finishing therein. Such finishing has generally been conducted in the finishing chamber of such finishing machines employing a suitable loose abrasive media and parts or workpieces to be finished, usually together with a liquid such as water, and frequently together with agents such as detergents, brightening agents, or lubricating agents of a soapy nature, generally referred to as "compounds". In the finishing chambers of such devices, the parts or workpieces to be finished are subjected to relative movement with respect to the loose finishing media, which may be anything from rock fragments to ceramic "chips" to steel burnishing balls, and the vibratory and/or rotative action imparted to the finishing chamber when in place in such finishing machines produces such relative motion. In vibrational or gyrational apparatus, such relative motion is considered to be both of a micro and a macro nature, inasmuch as the parts to be finished and the loose media move back and forth with respect to each other in an extremely localized area to an extremely localized extent in addition to moving with a generally rolling motion. In both tub-type and curvilinear finishing machines, having an arcuate bottom, the entire mass of loose finishing media and parts or workpieces generally moves with a rolling motion, going down at the inside of the finishing chamber and coming up at the outside of the finishing chamber, such motion generally being referred to as the "roll". In addition, in curvilinear finishing machine, e.g., the gyratory type of a machine having a curvilinear finishing chamber, usually an annular bowl having a U-shaped cross-section, with or without a step in the bottom, an additional component known as "feed" or "precession" is also introduced. According to the skill of the art, this is generally controlled by the relative settings of weights carried by an eccentric shaft or located on opposite ends of the shaft of an eccentric motor. Sometimes, in linear tub-type vibratory finishing machines, such precession is also provided by employing a corresponding slope in the bottom of the finishing chamber.

As the art has progressed, the elastomeric finishing chamber linings have become more and more sophisticated, as might be expected. However, they have not necessarily been satisfactory for all purposes, even at their previous highest degree of development. Efforts have been made to improve their compression-resilient properties and their wear-resistant properties. See, for example, U.S. Pat. No. 4,162,900, which is representative of finishing chamber linings of an improved nature. However, improved compression and wear-resistance are not the only problems inherent in such finishing chamber linings. In point of fact, a more important shortcoming of existing linings is only recognized and remedied according to the present invention, since prior thereto the problem, although recognized, was thought to be unidentifiable with any particular element of the finishing machine or chamber, and hence efforts to solve the said problem were not made by attention to and alteration of the finishing chamber lining.

The problem is as follows: Since introduction of vibratory finishing in the late 1950's, it has been difficult to make finishing media, particularly metal finishing media, and particularly steel balls as are used for burnishing and cleaning of parts, "roll" and "feed". In both tub-type and bowl-type vibratory machines, the mass of parts to be finished and finishing material would suddenly and unpredictably "flatten out" and refuse to "roll", thus not performing the intended function of the process and machine, inasmuch as vibratory finishing processes require a smooth, orbital, rolling action or "roll" to "scrub" the parts and keep them buried in the mass of finishing material. This problem worsened with the introduction of annular gyratory finishing machines of the SPIRATRON (TM - Roto-Finish Company, Inc.) type, because of the rise in the arcuate bottom of such devices. The finishing machine would suddenly stop "feeding", as this term has been above-defined. The problem was also aggravated by the introduction of synthetic elastomeric finishing chamber linings, such as polyurethanes, which have replaced the natural rubbers to a large extent. The reasons for the problem are unknown, but the problem in retrospect appears to be related to material hardness. In general, urethane linings are harder than rubber, and hence have been previously considered longer-wearing and more economical, but in retrospect it is believed that the hardness of the urethane linings contributes at least in part to the problem just outlined, which can be characterized as inactivity, depression, or dead spots within the finishing chamber when in use with finishing media and workpieces to be finished therein.

No prior art proposing or leading to a solution of the problem is known to the inventor, except as outlined hereinafter.

Many factors are considered to be involved in this erratic phenomenon or behavior of the finishing media and workpieces during the vibratory finishing process, among which are the size, the structure, the amplitude and frequency of the vibrations, the design of the machine, the type of workpieces involved, the type of loose finishing material and "compound" involved, possible eddying within the mass of media and workpieces caused by the design or shape of the finishing material, and so on. Many factors are obviously involved in this stagnation of the work action within the finishing chamber of a vibratory finishing machine when it occurs.

Temporarily stable conditions have sometimes been achieved by varying the following conditions:

1. Vibrator power. An increase in eccentric force is the most common method employed. This has the drawback of increased machine cost, low bearing life, hammering of the parts, a high noise level, and a higher media-wear rate.

2. Chemical "compound" variation. By varying the lubricity of the chemical "compound" employed, improved results can sometimes be obtained. This was probably the most significant prior technique but, for unknown reasons, cannot be relied upon. Considerable work is still being done in this area.

3. Varying machine speed of vibration. Here again, only a temporary cure is provided. Variable speed drives are, moreover, expensive.

4. Ribbing, scoring, or dimpling the finishing chamber lining. This approach is in wide use, but generally provides only a temporary cure for the stagnation phenomenon.

5. Feeding vanes. The addition of feeding vanes definitely interferes with parts and generally provides only a temporary solution.

6. Variation in drain size, type, and number of drains. This has some effect on the stagnation phenomenon, but not a major effect.

7. All of the foregoing. Variations of all of the foregoing are generally employed in difficult situations. Even so, some customer problems cannot be solved, resulting in return of a finishing machine or the loss of a sale since the machine simply cannot be made to perform satisfactorily under use conditions.

8. Addition of fine abrasives. The addition of fine abrasives, such as ten-micron silica, to the mass of finishing media and workpieces is effective in some cases to make the mass "roll" and "feed", but the abrasive discolors the media and parts and therefore is not acceptable. Even colloidal silica has been introduced into the mass with fair results as far as improvement of "feed" and "roll" phenomena, but still exhibits the disadvantage of discoloration of parts and media.

Accordingly, it is apparent that a solution to this longstanding problem is long overdue and highly desirable. Such is provided according to the present invention.

OBJECTS OF THE INVENTION

It is an object of the present invention to provide a finishing machine lining which alleviates at least to a certain extent the problems of stagnation, inactivity, depression, dead spots or erratic behavior of the mass of loose finishing media and parts or workpieces within vibratory and other type finishing chambers during a finishing operation. It is a further object to provide a finishing chamber lined with such an improved lining, a finishing machine embodying such a finishing chamber, and a method of making such a finishing chamber comprising lining the same with such an improved lining. It is another object of the invention to provide an improved method of finishing a workpiece with loose finishing media comprising the step of vibrating the same in a vibratory finishing machine comprising a finishing chamber lined with such an improved finishing chamber lining.

Still an additional object of the invention is to provide a method of increasing the work action within a finishing chamber of a vibratory finishing machine comprising the step of carrying out such vibratory finishing in a vibratory finishing machine comprising a finishing chamber having such an improved finishing chamber lining. Other objects will be apparent to one skilled in the art and still other objects of the invention will become apparent hereinafter.

SUMMARY OF THE INVENTION

The foregoing elucidated problem is solved or greatly reduced by the provision of the various embodiments of the present invention, which include a finishing chamber lining suited for use as a lining for any industrial finishing machine, but particularly suited for use in vibratory, including gyratory, finishing machines, comprising a compressible elastomeric substrate having a particulate, insoluble abrasive material uniformly distributed therethrough and having a working or outer surface, the abrasive having a particle size between one (1) and 100 microns and a hardness, as measured on the Mohs scale, of at least one (1), the abrasive material being insoluble in the elastomeric substrate and in reactants and solvents employed in producing the same, said working surface comprising an outermost abrasive-interspersed gripping surface which is adapted to be self-regenerating upon erosion in use. This finishing chamber lining, when in place in a finishing chamber, increases the work action between the parts and finishing media within the finishing chamber and minimizes stagnation, inactivity, depression, or dead spots within the finishing chamber when in use with loose finishing media and workpieces to be finished therein. The elastomeric substrate is preferably selected from the group including natural and synthetic elastomers, and preferably comprises polyurethane. The Mohs hardness of the abrasive material is preferably at least five (5), and preferably at least a portion of the abrasive material has a particle size of at least five (5) microns. The elastomeric substrate preferably has a Shore A hardness of at least fifty (50), usually fifty (50) to a hundred (100), and preferably sixty-five (65) to ninety (90).

The present invention also comprises a finishing chamber lined with such lining, and a vibratory finishing machine comprising such a lined finishing chamber. It also comprises a method of making a finishing chamber comprising the step of lining the finishing chamber with such a lining, and a method of finishing workpieces with loose finishing media by subjecting the same to vibration in a vibratory finishing machine comprising such a lined finishing chamber. It further comprises a method of increasing the work action within the finishing chamber comprising the step of carrying out such vibratory finishing in a vibratory finishing machine comprising a finishing chamber lined with such type of lining.

The reasons for the success of the present invention are not presently known, but it suspected that the abrasive uniformly distributed throughout the elastomeric substrate increases the coefficient of friction between the outer layer of loose finishing media, e.g., the outer steel ball layer, and the working face of the finishing chamber lining, at the micro level. Surprisingly and advantageously, the amount and release of the abrasive, e.g., silica, from the working face of the finishing chamber liner is such that no observable discoloration of the workpiece or part being finished takes place.

Other aspects of the invention will become apparent hereinafter.

THE ELASTOMER

Any suitable and usual elastomer can be employed in producing the finishing chamber lining according to the invention. The term "elastomeric substrate" as used herein is to be understood to be a substrate formed of either natural or synthetic elastomers which stretch under tension, have a high tensile strength, retract rapidly, and essentially recover their original dimensions fully. Examples of such suitable elastomers which can be employed in production of the elastomeric finishing chamber lining according to the invention include natural rubber, homopolymers such as polychlorobutadiene, polybutadiene and polyisoprene, copolymers such as styrene-butadiene rubber, butyl rubber, nitrile rubber, ethylene-propylene copolymers, fluorine elastomers, and polyacrylates, polycondensation products such as polyurethanes, neoprene, ABS rubber, PVC rubber, silicone rubber, and polysulfide rubber, and chemical conversions of high polymers such as halogen-substituted rubbers. The elastomeric substrate generally has a Shore A hardness of between fifty (50) and one hundred (100), with a Shore A hardness of about sixty-five (65) to about ninety (90) usually being preferred. Further information regarding the elastomer is to be found under the heading "GENERAL PROCEDURE" and in the detailed examples.

THE ABRASIVE

The abrasive may, for example, be ceramic, porcelain, metal, titanium or aluminum oxides, silicon oxide, silicon dioxide, silicon carbide, granite, limestone, or other stone chips. It may also be diamond, corundum, emery, garnet, silica abrasives such as quartz, quartzite, silica sand, buhrstone and the like, or other rocks and minerals such as barite, pumice, pumicite, quartz conglomerate, and the like. Suitable synthetic abrasives are diamond, fused alumina, glass, ceramic materials such as hard porcelain, boron nitride, tantalum carbide, tungsten carbide, $Al_2O_3$, powdered $Al_2O_3$, and metal abrasives such as steel or iron shot, angular grit, and the like.

In selecting the abrasive, not only the hardness but also economy must be considered. Thus silica is preferred, according to the present invention, for most applications. Particularly suitable types of silica are those known as Min-U-Sil TM and Supersil TM having particle sizes ranging from one (1) micron to slightly above five (5) microns, approximately two (2) microns to slightly above ten (10 ) microns, from three (3 ) microns to slightly above fifteen (15) microns, and from four (4) microns to slightly above thirty (30) microns, depending upon the grade employed. These products are distributed by Pennsylvania Glass Sand Company, and comprise mainly silicon dioxide, together with minor portions of iron oxide, aluminum oxide, and titanium dioxide, with traces of calcium oxide and magnesium oxide.

The abrasive should have a particle size between one (1) and 100 microns. Particle sizes of at least one (1) micron are adequate, and preferably at least a part of the abrasive will have a particle size of at least five (5) microns. As pointed out for the Min-U-Sil TM series, particle sizes between one (1) and thirty (30) have been found eminently suitable.

As far as the hardness of the abrasive, a hardness of at least one (1) on the Mohs Hardness Scale is suitable for many purposes. However, a Mohs hardness of at least five (5) and preferably of at least seven (7) is preferred, although concessions must be made in the interest of economy. Moreover, a judicious selection of the abrasive should be made with respect to hardness as combined with particle size, in view of the parts or workpieces being finished, to obviate the possibility of any undesirable surface characteristics being transmitted to the part or workpiece being finished by the abrasive constituting a part of the working face of the finishing chamber lining. When said working surface comprises an outermost abrasive-interspersed gripping surface having uniformly distributed therein and therethrough silica having a particle size up to about thirty (30) microns, no discoloration or scratching of the surface of the parts or workpieces being finished has been observed. Accordingly, a particle size between about one (1) and thirty (30) microns is especially preferred, although a particle size up to about fifty (50) microns presents no ascertainable problems, and a particle size up to 100 microns is generally satisfactory.

RELATIVE AMOUNTS

The relative amounts of the abrasive and elastomer are not critical, but certain outer limits should be observed for purposes of economy and convenience. The amount of the abrasive weight to total weight of elastomer can be up to fifty percent (50%), that is, they can be present on a fifty-fifty basis. However, lesser amounts of abrasive have been found generally satisfactory, between about twenty (20) and twenty-five percent (25%) by weight of abrasive to weight of elastomer having been found suitable. For reasons of economy, there seems to be no reason to exceed thirty percent (30%) of abrasive by weight of elastomeric substrate. For any particular application, it is a simple matter to increase the amount of abrasive until a satisfactory ratio is obtained for maximum working efficiency under a particular prescribed set of conditions.

FINISHING MACHINES

According to the present invention, representative types of finishing machines are those used for grinding, deburring, descaling, edge-breaking, polishing, bright-honing, burnishing, and other surface finishing of parts or workpieces, which may and generally do comprise wood, metal, ceramic, glass, or the like. As already pointed out, the problem to which the present invention provides at least a partial solution is most prominent in the area of ball burnishing.

In addition to U.S. Pat. No. 4,162,900, previously referred to as representatively showing a vibratory finishing machine embodying a finishing chamber lining, may be mentioned also U.S. Pat. Nos. 3,161,993; 4,012,869; and 4,022,012, respective reference being made to column 5, column 7, and column 9 thereof. For still other types of finishing apparatus wherein finishing chambers lined with an elastomeric substrate may be advantageously employed, reference is made to U.S. Pat. Nos. 3,981,693, 3,990,188, and 4,172,339 as well as to copending U.S. Ser. No. 869,469, filed Jan. 16, 1978 and issued as U.S. Pat. No. 4,177,608 on Dec. 11, 1979. As previously stated, the finishing chamber may be employed in a vibratory machine, a rotational finishing machine, a combination of vibratory or gyratory and rotational machine, a tumbling barrel, or any conventional type, whether the finishing chamber itself is tub-type, curvilinear, annular, annular with a step in its bottom, and so on. The finishing chamber lining of the invention is advantageous for any finishing chamber wherein it is desired to obtain an improved working action between the interior lining of the finishing chamber and the loose finishing media and parts or workpieces therein. As used herein, "gyratory" is a particular species of "vibratory" as applied to a finishing process or machine.

FINISHING MEDIA

By the term "loose finishing material" or "finishing medium", as used here, is intended to include loose, comminuted, granular, or particulate, and in any event, solid finishing materials of the type which are presently employed in the trade and any others of a similar nature. Although liquid finishing materials or "compound" may also be used in conjunction with the solid finishing materials, these are considered to be ancillary for purposes of the present invention, the finishing process of which in all cases employs at least some solid finishing medium. Moreover, the terms first set forth in this paragraph are used herein generally to designate such solid materials which are used to impart all types of finishes including those finishes acquired with abrading materials as well as polishing materials and the like, "polishing", "burnishing", etc., being terms considered in their usual sense as species of "finishing".

Such suitable finishing media include porcelain, ceramic, aluminum, steel, zinc, stainless steel, granite chips, and the like, all as well-known in the art, and in various sizes and configurations, also as well-known in the art. Such configurations are representatively cones, bars, cylinders, squares, stars, and the like.

GENERAL PROCEDURE

In general, the particulate abrasive material may be admixed with and uniformly distributed throughout the elastomeric substrate in any suitable, convenient, or conventional manner. For natural elastomers, such as natural rubber, and material of a similar nature, the abrasive may be uniformly distributed or dispersed throughout by kneading in a conventional rubber mill or by passing a plurality of times between rollers or toothed rollers, if necessary with the application of heat, so as to produce the desired uniform dispersal or distribution of the abrasive particulate material throughout the elastomeric substrate prior to placement in its final form for application as a finishing chamber liner. Conventional kneaders, stirrers, or rollers, as are well-known in the rubber industry, may be employed for such purposes. When the elastomer is of the polyurethane type, it may of course be prepared by the prepolymer method or by mixing the ingredients concurrently or simultaneously through several nozzles in a so-called "one-shot" application involving the instantaneous reaction of two or three components. Where solvents are involved, this is of no consequence except that the particulate abrasive materials should be insoluble in any solvents employed in the production or application of the elastomer as well as in the components reacted to produce the elastomer, as well as in the elastomer itself, since otherwise the abrasive effect will be lost due to solubility. Generally, it is preferred to employ elastomeric substrates having a Shore A hardness between fifty (50) and one hundred (100), with Shore A hardness of between sixty-five (65) and ninety (90) being more common. The ADIPRENE TM family of urethane elastomers produced by DuPont, and CONATHANE TM two-component polyurethane casting systems, produced by Conap, Inc., Olean, N.Y., are particularly suitable for use in accord with the present invention. The CONATHANE TM TU-79 system is particularly adaptable to the production of finishing chamber linings inasmuch as it attains a Shore A hardness of 80±5 and has excellent tensile strength and compression characteristics. Moreover, upon admixture of the two parts of the two-part system, the initial mixed viscosity at 25° C. or 77° F. is only 4,000 cps, thus making it pourable into almost any configuration for the production of finishing chamber linings according to the present invention, whether in forms to be subsequently bonded to the finishing chamber or whether poured directly into the finishing chamber, thereby to become self-bonding to the interior surface thereof upon curing. With a pot-life of 35 to 40 minutes at 25° C. and the ability to cure at room or elevated temperatures, this system has been found highly satisfactory. The cure of one hour at 25° C. plus 16 hours at 80° C. is convenient and, alternatively, the applied elastomer can be cured by allowing to stand for seven (7) days at 25° C. If molds are used, mold releases can if desired also be employed to obtain rapid, clean, and convenient relase from the mold, as is conventional in the art. The linings are preferably bonded to the finishing chamber interior by pouring in place in fluid or semifluid condition and allowing to cure in place, with possible application of heat and use of curing agents if desired, or they may be preformed and bonded to the finishing chamber by application of external heat and/or adhesives, as conventional in the art.

DESCRIPTION OF THE DRAWINGS

A more complete understanding of the invention may be had by reference to the following detailed description when taken in conjunction with the accompanying drawings, wherein.

DETAILED DESCRIPTION

Figure 1:
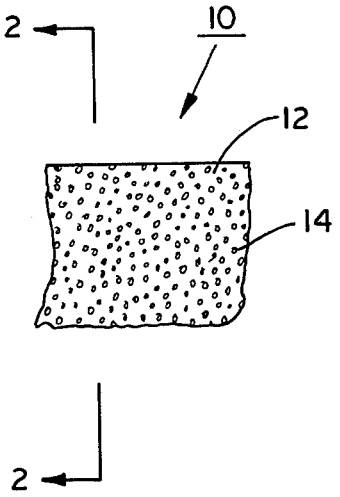
FIG. 1 is an enlarged partial face view of a finishing chamber lining in accord with the present invention.

Referring now to the drawings, and particularly to FIG. 1 thereof, the finishing chamber lining of the invention is shown in an enlarged partial face view at 10. The elastomeric substrate is shown at 12 and the abrasive grains uniformly distributed therethrough are shown at 14.

Figure 2:
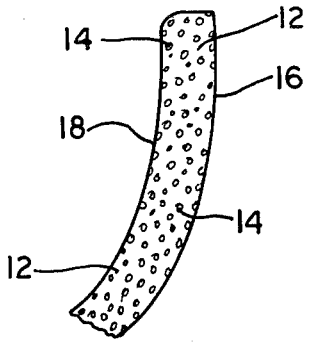
FIG. 2 is a cross-sectional view of the finishing chamber lining of FIG. 1 taken along the line 2—2 thereof.

FIG. 2 shows an enlarged cross-section of a finishing chamber lining or liner according to the invention, being a cross-section of the finishing chamber lining of FIG. 1 taken along the line 2—2 thereof. In FIG. 2 are indicated the non-working surface 16 and the working surface 18 of the finishing chamber lining or liner. By the term "working surface", as used herein, what is intended is the exposed surface of the lining or liner when in place in a finishing chamber, and which is subjected to abrasion or friction or at least to the working action of the contents of the finishing chamber when in operation. Conversely, the term "non-working surface" is to be understood as meaning that surface which is opposite to the working surface of the lining of the invention and which is not subjected to the abrasion and/or friction and/or working effects of the contents of the finishing chamber when the finishing machine in which such a chamber is mounted is in operation.

Figure 3:
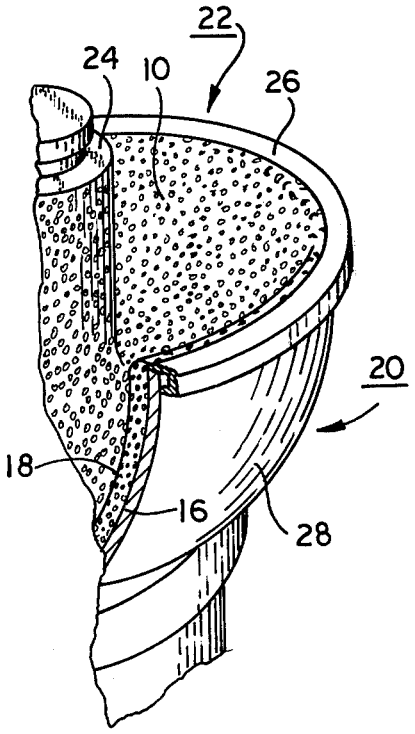
FIG. 3 is a partial perspective view of a vibratory finishing machine incorporating a finishing chamber lining or liner in accord with the present invention.

In FIG. 3 is shown the liner in place in the finishing chamber, in turn in place in a vibratory finishing machine. The vibratory finishing machine 20 depicted in FIG. 3 is of the type including a toroidal bowl or hopper 22. This toroidal bowl 52 may also be considered as comprising an annular hopper having a generally U-shaped cross-section. The bowl or hopper 52 has an interior upper circular rim 24 and an outer upper circular rim 26, each extending around the entire circumference of the bowl 22. The bowl 22 may or may not have a step in the bottom thereof, depending upon the use for which the vibratory finishing machine is intended and the method of separation of the contents to be employed in conjunction with the finishing process conducted therein. The vibratory finishing machine 20 utilizes a hopper or bowl 22 comprising an outer bowl or tub 28. Such tub 28 is typically formed of a suitable metal, such as steel, and is mounted on suitable springs or other resilient material (not shown) so as to permit vibration of the hopper or tub 22 and the contents thereof. Depending upon the type and location of the drive means employed in conjunction, and its orientation with respect to the bowl 22, the finishing chamber, e.g., bowl or hopper 22 of the finishing machine 20, will either vibrate or gyrate according to knowledge and procedure which is already standard in the art. A liner 10, comprising the finishing chamber lining of the present invention, extends over the entire interior of the finishing chamber, e.g., bowl or tub, 22. The working surface of the liner is shown at 18, whereas the non-working surface 16 thereof is shown as bonded to the interior of outer bowl or tub 28.

It is to be clearly understood that the finishing chamber liner of the present invention is not in any way limited to liners for vibratory or gyratory finishing machines having the particular construction illustrated in FIG. 3, but that it may be employed in or in conjunction with the finishing chamber of any standard industrial abrasive-type machine of the vibratory or gyratory or other type, whether tub-type or curvilinear, e.g., annular with an arcuate bottom, whether solely or additionally mounted for rotative or spinning movement, whether involving means for automatic separation or not, and whether including partitions or dividers for maintaining parts or workpieces separate from each other during a finishing process, or otherwise, all as is now well-known in the art. The only limitation to be imposed upon the finishing chamber lining of the present invention is that it is suitable for use in an industrial finishing machine, particularly of a vibratory or gyratory nature.

In order to depict the proven and highly-desirable characteristics of the finishing chamber lining of the present invention, the following examples are provided. These examples are to be understood as being by way of illustration only, and are not to be construed as limiting the scope of the present invention.

EXAMPLES

A CONATHANE TM TU-79 brand of polyurethane lining was prepared and applied to a finishing chamber by admixing components A and B and then introducing into the mixture twenty percent (20%) by weight of Min-U-Sil TM 30 silica based on the weight of the elastomer. The lining was applied to the interior surface of the finishing chamber of two (2) separate machines in the normal manner at room temperature during pot-life of the material and then allowed to cure according to directions by the application of exterior heat. In each case, the lining had a normal appearance and hardness, but the silica was uniformly distributed throughout the thickness of the finishing chamber lining and the working surface of the lining comprised an outermost abrasive-interspersed gripping surface which was found to replace itself or to be self-regenerating upon erosion during use.

The one (1) machine, the finishing chamber of which was so lined, was an ST-1, being a one (1) cubic foot SPIRATRON (trademark of Roto-Finishing Company, Inc.) gyratory finishing machine. The second finishing machine, the finishing chamber of which was so lined, was an ST-20 B, being a twenty (20) cubic foot SPIRATRON (trademark of Roto-Finish Company, Inc.) gyratory finishing machine.

Comparative Example 1—In the ST-1, various test parts of metal were finished with 5/32" inch steel balls. The gyratory finishing machine was run for 100 hours, using various chemical burnishing compounds and brighteners and cleaners. Both "roll" and "feed" were excellent. No deterioration of the surface of the test parts could be observed.

Comparative Example 2—The ST-1 was run for three (3) hours using standard metal test parts and 5/32" steel balls, but employing XL-352 (trademark, Roto-Finish Company, Inc.) compound, an extremely "soapy" compound. The "feed" and "roll" were good. The finish on the parts was excellent.

Comparative Example 3—Exactly the same test parts were subjected to finishing with 5/32" steel burnishing balls in exactly the same amounts and under the same conditions as just given in Comparative Example 2 in an ST-1 SPIRATRON finishing machine having a finishing chamber lined with the standard CONATHANE TU-79 brand of polyurethane lining without any silica therein. Neither "roll" nor "feed" were imparted to the mass of steel burnishing balls and parts to be finished in the standard-lined ST-1.

Comparative Example 4—In exactly the same manner as given in Comparative Example 1, but employing a standard-lined ST-1 having a finishing chamber lined with standard CONATHANE TU-79 polyurethane lining without abrasive grains uniformly distributed therein. The results are erratic and unreliable "feed" and "roll" and sometimes no "roll" and no "feed" at all.

Comparative Example 5—In the ST-20 SPIRATRON machine, using the same metal test parts and 5/16 inch steel ball cones, the drains in the SPIRATRON being the normal urethane-lined drains, five (5) different chemical compounds were tested, including the compound "ROTO-BRITE" L-888 (trademark, Roto-Finish Company, Inc.), a liquid cleaner of high concentration which normally cannot be used because of bad "feed" and "roll" in the mass of finishing media and parts when it is employed.

The ST-20B with the lining according to the present invention was run for 179.4 hours. Regardless of the chemical compound employed in the test, regardless of the concentration, the ST-20B embodying a finishing chamber lined according to the present invention gave a satisfactory roll and feed of the mass of media and parts therein. The color of the parts subjected to the test run was good. These results were achieved employing a machine amplitude of two and one-half (2½ ) millimeters, which is thirty percent (30%) less than normally employed, thus enabling a saving of power and bearing stress.

Comparative Example 6—In an ST-20B lined with a natural rubber lining, bonded to the inner surface of the finishing chamber thereof, and containing uniformly dispersed therein fifty percent (50%) by weight of granite chips, uniformly distributed throughout the natural rubber by kneading under the application of heat and thereafter forcing between heated rollers, door handles are burnished with 5/16 inch steel ball bearings. Different chemical compounds are employed. Normal amplitudes are used. A satisfactory "roll" and "feed" are obtained with all of the compounds employed, regardless of their concentration.

Comparative Example 7—In an ST-20B lined in the normal manner with natural rubber, but without particulate abrasive material uniformly dispersed therein, the same test parts are subjected to finishing with the same finishing material, using the same compounds and under the same conditions. The "roll" and "feed" are erratic and in some cases non-existent.

Comparative Example 8—In an ST-20B lined with CONATHANE TM TU 79 containing uniformly dispersed therein thirty percent (30%) by weight of Min-U-Sil TM 30 silica uniformly distributed throughout the elastomeric substrate, casters are finished with ⅜ inch ceramic cones. Different chemical compounds are employed. Normal amplitudes are used. A satisfactory "roll" and "feed" are obtained with all of the compounds employed, regardless of the concentration employed.

Comparative Example 9—In an ST-20B lined in the normal manner with CONATHANE TM TU 79, but without particulate abrasive material uniformly dispersed therein, the same test parts are subjected to finishing with the same finishing material, using the same compounds and under the same conditions. The 37 roll" and "feed" are erratic and in some cases non-existent.

It is thus seen from the foregoing that a novel finishing chamber lining, having a novel working surface comprising an outermost abrasive-interspersed gripping surface which is adapted to be self-regenerating upon erosion in use, finishing chambers lined therewith, vibratory and other finishing machines comprising such finishing chambers, a method of finishing workpieces with loose finishing media in a vibratory finishing machine comprising such finishing chambers, a method of increasing the work action within the finishing chamber of a vibratory finishing machine and minimizing erratic "roll" and "feed", stagnation, inactivity, depression, or dead spots within the finishing chamber, comprising carrying out said vibratory finishing in a vibratory finishing machine comprising such a finishing chamber, and a method of making the finishing chamber for a vibratory finishing machine comprising the step of lining the said finishing chamber with such a lining, have all been provided according to the present invention and have accomplished the objects of the present invention. The advantages are apparent, although the reasons therefor are not fully understood. As already stated, it is believed that an increased coefficient of friction provided by the outermost abrasive-interspersed gripping surface of the finishing chamber lining provided according to the present invention and the outer layer of finishing media, at the micro or local level, may at least in part be responsible for the advantageous results. Still other advantages deriving from the present invention will readily suggest themselves to one skilled in the art, as will other applications of the broader concepts of the present invention.

Although preferred embodiments of the invention have been illustrated in the accompanying drawings and described in the foregoing DESCRIPTION, it is to be understood that the invention is not limited to the embodiments disclosed or to the exact details of operation or exact compounds, compositions, methods, or procedures shown and described, since the invention is capable of obvious modifications, rearrangements, and substitutions of parts and elements and other equivalents without departing from the spirit or scope of the invention, as will readily be apparent to one skilled in the art.

I claim:

1. A vibratory or gyratory finishing machine, having a finishing chamber and vibratory or gyratory means operatively associated therewith for imparting vibrations or gyrations thereto, said finishing chamber comprising a lining adapted to increase the work action within the finishing chamber and minimize inactivity, depression, or dead spots within the finishing chamber when in use with loose finishing media and workpieces to be finished therein, said lining comprising:

a compressible elastomeric substrate having a particulate, insoluble abrasive material uniformly distributed therethrough and having a working or outer surface, said abrasive material having a particle size between one (1) and 100 microns and a hardness, as measured on the Mohs Hardness Scale, of at least one (1), said abrasive material being insoluble in the elastomeric substrate and in reactants and solvents employed in producing the same, said working surface comprising an outermost abrasive-interspersed gripping surface which is adapted to be self-regenerating upon erosion in use.

2. A machine of claim 1, wherein the elastomeric substrate is formed from a material selected from the group including natural and synthetic elastomers.

3. A machine of claim 2, wherein the elastomeric substrate comprises polyurethane.

4. A machine of claim 2, wherein the hardness of the abrasive material is at least five (5) on the Mohs Hardness Scale.

5. A machine of claim 2, wherein at least a portion of the abrasive material has a particle size of at least five (5) microns.

6. A machine of claim 2, wherein the elastomeric substrate has a Shore A hardness of at least fifty (50).

7. A machine of claim 2, wherein the amount of abrasive in the finishing chamber lining is up to one hundred percent (100%) by weight of the weight of the elastomeric substrate in which it is distributed.

8. A machine of claim 2, wherein the abrasive is silica.

9. A machine of claim 2, wherein the particle size of the abrasive material is about fifty (50) microns or less, and wherein the amount of abrasive in the finishing chamber lining is up to thirty percent (30%) by weight of the weight of the elastomeric substrate in which it is distributed.

10. A method of finishing a workpiece with loose finishing media comprising the step of subjecting the workpiece and the finishing media to vibration or gyration in a vibratory or gyratory finishing machine of claim 1, 2, or 9.

11. A method of increasing the work action within a finishing chamber of a vibratory or gyratory finishing machine and minimizing inactivity, depression, or dead spots within the finishing chamber thereof when in use with loose finishing media and workpieces to be finished therein, comprising the step of carrying out such finishing in a finishing machine of claim 1, 2 or 9.

12. The method of claim 11, wherein the loose finishing material is steel burnishing media.

* * * * *

UNITED STATES PATENT AND TRADEMARK OFFICE

CERTIFICATE OF CORRECTION

PATENT NO. : 4,307,544

DATED : December 29, 1981

INVENTOR(S) : Gunther W. Balz

It is certified that error appears in the above—identified patent and that said Letters Patent is hereby corrected as shown below: On the title page

[56] References Cited, U.S. PATENT DOCUMENTS;

| | | | |
|---|---|---|---|
| line 1; | "1977" | should read | -- 1917 -- |
| line 4; | "Upton" | should read | -- Upton, Jr. -- |
| line 5; | "Hofelmann" | should read | -- Hofelmann, et al. -- |
| line 7; | "Guilbert" | should read | -- Tocci-Guilbert -- |

Col. 1, line 50; "machine" should read -- machines --
Col. 4, line 50; "but it suspected" should read -- but it is suspected --
Col. 8, line 16; "relase" should read -- release --
Col. 8, line 68; "52" should read -- 22 --
Col. 9, line 2; "52" should read -- 22 --
Col. 11, line 30; change "37" to -- " --

Signed and Sealed this

*Eighth* Day of *June 1982*

[SEAL]

*Attest:*

GERALD J. MOSSINGHOFF

*Attesting Officer*

*Commissioner of Patents and Trademarks*